United States Patent [19]

Neumann

[11] 4,190,384

[45] Feb. 26, 1980

[54] CONCRETE CONSTRUCTION ELEMENT SYSTEM FOR ERECTING PLANT ACCOMMODATING WALLS

[76] Inventor: Herwig Neumann, Herrenberger Str. 39, 7031 Hildrizhausen, Fed. Rep. of Germany

[21] Appl. No.: 932,449

[22] Filed: Aug. 9, 1978

Related U.S. Application Data

[63] Continuation of Ser. No. 682,014, Apr. 30, 1976, abandoned.

[30] Foreign Application Priority Data

Apr. 30, 1975 [DE] Fed. Rep. of Germany ..... 2519232

[51] Int. Cl.[2] ..... E02D 5/20; A01G 9/12

[52] U.S. Cl. ..... 405/284; 47/83; 52/609

[58] Field of Search ..... 405/284, 286; 47/83; 52/27, 609

[56] References Cited

U.S. PATENT DOCUMENTS

| | | | |
|---|---|---|---|
| 2,514,536 | 7/1950 | Burney | 47/83 |
| 2,888,779 | 6/1959 | Hostetter | 47/83 |
| 3,374,574 | 3/1968 | Haile | 47/83 |

FOREIGN PATENT DOCUMENTS

| | | | |
|---|---|---|---|
| 871125 | 2/1953 | Fed. Rep. of Germany | 52/609 |
| 4781 | of 1905 | United Kingdom | 52/27 |

*Primary Examiner*—John E. Murtagh

*Attorney, Agent, or Firm*—Schwartz, Jeffery, Schwaab, Mack, Blumenthal & Koch

[57] ABSTRACT

Disclosed is a system of construction elements for the erection of plant-accommodating, slope-retaining walls comprising L-shaped longitudinal elements arranged in multilevel relationship, having a horizontally extending base plate portion and an upwardly extending railing portion; and sectional support elements acting as vertical spacers for the longitudinal elements extending horizontally in a direction perpendicular to the direction of the longitudinal elements and having upper and lower seating surfaces adapted for communication with the base plate portion of the longitudinal element; wherein a slope-retaining wall formed from the L-shaped longitudinal elements and the sectional support elements capable of dividing shearing forces acting on the wall vertically and longitudinally so that the wall stands erect, retains a slope surface and provides areas for the accommodation of plants, small foliage or the like.

14 Claims, 12 Drawing Figures

CONCRETE CONSTRUCTION ELEMENT SYSTEM FOR ERECTING PLANT ACCOMMODATING WALLS

Figure 1:
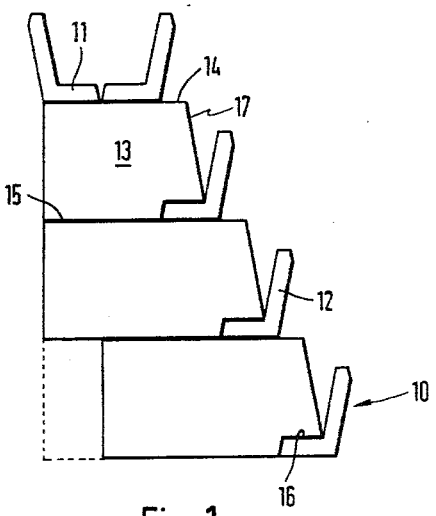

This is a continuation of application Ser. No. 682,014 filed Apr. 30, 1976.

The invention relates to a system of construction elements made out of concrete for the erection of plant accommodating walls and slope reinforcements and the like which offer various possibilities of arrangement and design in landscaping.

Walls for defining and separating parcels of land for purposes such as enclosure or for visual protection, particularly for the reinforcement of a slope can only be interrupted and planted in intervals, if the wall is constructed in the form of an embankment or if it inclines steeply with the slope to provide terraces for planting. Previously closed reinforcement walls were used for road embankments in hilly areas or for the sloped embankment of underpasses and in many other cases. Walls of this type require expensive construction techniques including moulding, armouring and use of poured-in-place concrete and furthermore, provide an appearance which ruins the landscape. Even common concrete reinforcement walls require expensive construction because they must be built frost-resistant and embedded deeply in the ground, in order to withstand the influence of weather and ground pressures next to the slope.

The present invention is base on the concept of replacing commonly used closed reinforcement walls constructed of concrete, with a discontinuous system of construction of transportable prefabricated elements. At the construction site, vertical or arbitrarily inclined walls can be built from these elements and, thereafter, provide facilities for plant accommodating of the walls when completed.

According to the invention, the system of concrete construction elements is characterized by longitudinal elements with a horizontal base-plate and, at least on one side, an auxiliary wall member which is upwardly adjoined either obtusely or rectangularly and, furthermore, by sectional support elements, which have a horizontal seating surface at the top and underneath. These sectional support elements are arranged at right angles to the longitudinal direction of the wall and serve as connectors to the adjacent longitudinal elements and, in the vertical direction, as spacers determining the desired height between each level of planting areas on top of one another.

The longitudinal elements of a preferred embodiment form an approximately L-shaped profile in the cooperation of the base-plate and the obtuse railing portion. The planting area as well as the area open to air and light is extended by the forward-inclining auxiliary wall member. Planting floors are created, when the longitudinal elements are arranged in space relationship on top of each other. Accordingly to the selection of sectional support elements of an appropriate height, walls or reinforcement walls of different inclines can be constructed. Even in case of vertical walls, every floor can be plant accommodating because the distance between the planting floors remains variable according to the height of the sectional support elements.

The L-profile has a further advantage. This form guarantees an automated production of concrete construction components, because the elements have no cut-out back sections. The L-profile makes it possible to achieve a direct connection of the added planting soil with the ground of the slope or embankment that is to be supported. The seating of the longitudinal elements on the sectional support elements remains independent from the later filling of the planting soil that is put in the area defined by the sectional support elements and longitudinal elements.

One of the main features of the invention is the spaced and variable relationship between the longitudinal elements and the sectional support elements. The spaced relationship makes joints of different sizes possible. This is of great interest when a spiral or curved wall has to be erected with longitudinal elements of the same size. This is accomplished by bridging the different widths of the joints with sectional support elements measured adequately broad enough. The variable width of the joints is of importance when the necessary longitudinal adjustment for the recessed location of each upper planting-floors in a 90 degree curve must be achieved by utilizing the longitudinal elements of the same length.

The sectional support elements are set on top of one another perpendicular to course of the wall and form partitions at the slope which extend over the height of the wall. Within the partitions, formed by two neighboring sectional support elements, land movements and shearing forces remain controllable and are absorbed without problems by the floors formed from the longitudinal elements.

The sectional support elements of one preferred embodiment have horizontal seating surfaces at the top and underneath, upon which the elements are set on top of one another. They secure the position of the wall permanently because of their own weight. Each sectional support element has a recess at the front edge where the horizontal base-plate of the longitudinal elements are installed. The sectional support elements can be subdivided according to their height to simplify handling and production. They can be assembled to support beams of any height as long as each beam has a recess at the front edge for the installation of the base-plate of the longitudinal elements.

In another embodiment of the invention the sectional support elements are symmetrically aligned with the obtuse angle between base-plate and the auxiliary wall member of the longitudinal element. On the upper side of each sectional support element a bolt can be secured such as by screwing into the concrete or attachment at the concrete pouring stage for the fastening of a cover plate which overlaps the ends of the base-plate of two neighboring longitudinal elements. Because of this, the horizontal impact of the pressure caused by the slope is absorbed in such a way that the longitudinal elements with their own weight, the weight of the soil filling on each specific level and with the strength produced by the attached cover plate, are pressed on the support underneath and are prevented from moving by the forces of friction.

In general, however, the weight of the longitudinal elements and the weight of the added soil are sufficient to absorb the pressure on every planting-floor within the partition.

In another embodiment the sectional support elements have symetrically arranged mirror imaged upper and lower extending areas by means of which the sectional support elements are aligned adjacent to the rear edge. In this case, horizontal shearing forces caused by the slope are absorbed by the form contact.

In case of a straight, horizontal and flat upper side of the sectional support elements, the wall can be constructed in any incline, even vertical. A steeper incline decreases the available planting area as well as the lighted area, provided the height of each sectional support element remains the same. The wall may still be plant accommodating, however, if one chooses higher sectional support elements. The static requirements of higher walls are mainly taken into account by the fact that the lower sectional support elements are of greater length and consequently can be embedded deeper into the slope. In the case of walls of normal height (200 cm), one can do without the assistance of longer sectional support elements because the shearing forces are divided according to the number of planting-floors.

According to a second basic embodiment of the invention, the longitudinal elements can form through-like elements by attaching auxiliary wall members on both sides of the base-plate obtusely. The assigned sectional support elements are aligned with the inside profile of the trough. The profile of the trough, for example, is used when the covered slope has to be protected against wetness or the growing of roots, or when the different levels of the slope to be reinforced carry water which should not penetrate to the outside. Furthermore, free-standing plant accommodating walls can be constructed with trough-like elements, e.g. walls for visual protection. Such free-standing walls, constructed from closed or latticed trough-like elements, can be matched to neighboring buildings.

Figure 3:
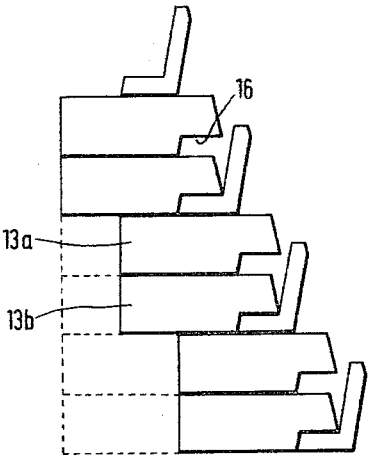
Figure 2:
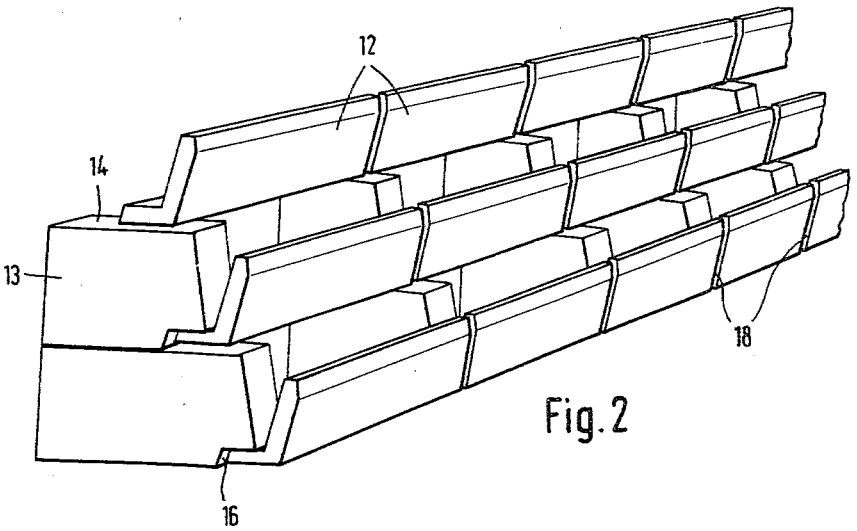
Figure 9:
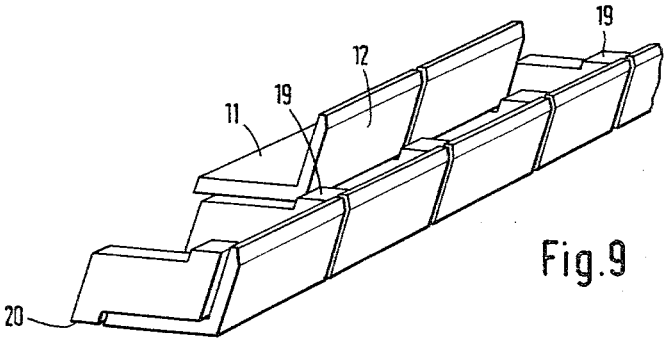
Figure 4:
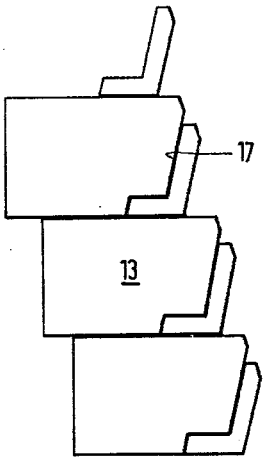
Figure 5:
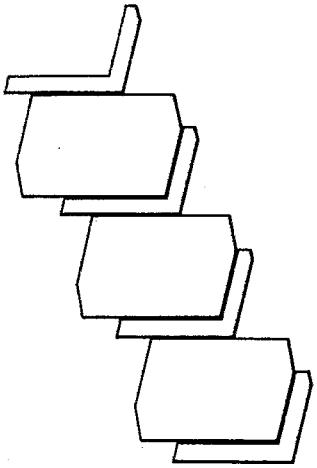
Figure 6:
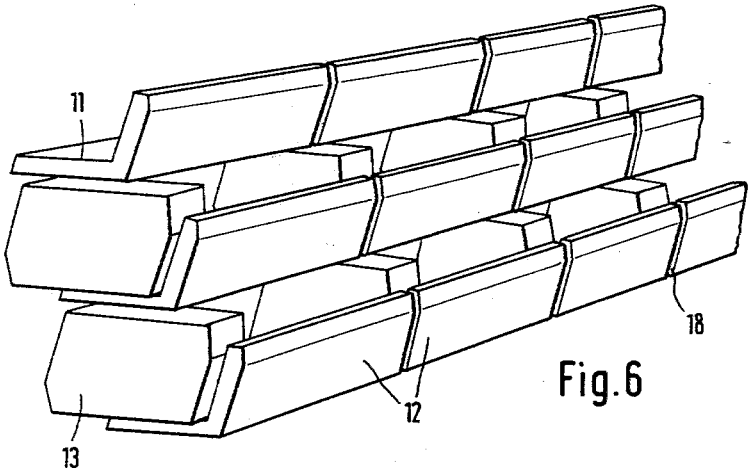
Figure 7:
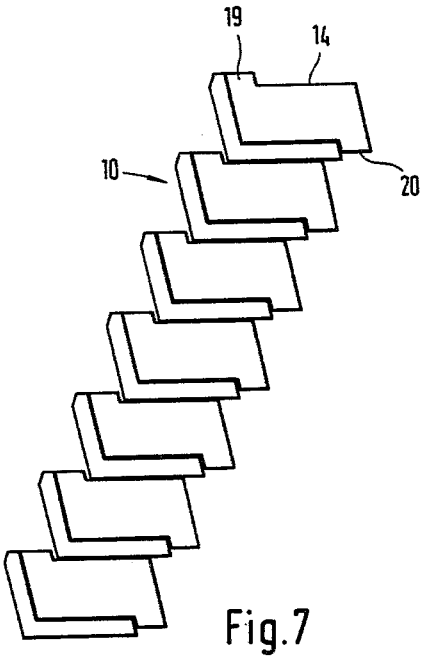
Figure 8:
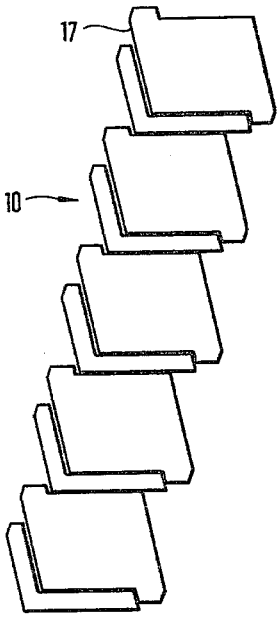
Figure 10:
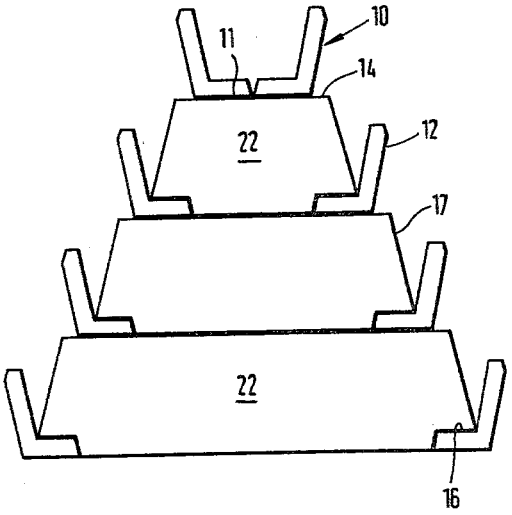
Figure 11:
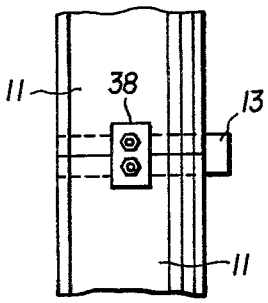
Figure 12:
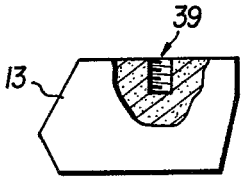

Accordingly, the invention is described in more detail by means of the drawings. Schematically is shown:

FIG. 1, a lateral view of a plant accommodating reinforcement wall according to the invention, FIG. 2, a perspective view of a reinforcement wall similar to FIG. 1, FIG. 3, a lateral view similar to FIG. 1 showing divided sectional support elements, FIG. 4, a lateral view showing sectional support elements for a steeper incline of the wall, FIGS. 5, 6, a lateral and a perspective view of a reinforcement wall constructed of longitudinal elements with wide base-plates, FIGS. 7, 8, lateral views of reinforcement walls constructed from a different kind of sectional support elements, FIG. 9, a perpective partial view of a reinforcement wall corresponding with FIG. 7, FIG. 10, a lateral view of a sound-absorbing wall constructed of elements similar to FIG. 1, FIG. 11, a top view of the reinforcement wall showing two base plate members joined by connecting links in a form of a butt strap fastened to studs protruding from the upper side of a sectional support element, and FIG. 12, a lateral view of a sectional support element as in FIG. 5 partially cut away to demonstrate a screw socket on the upper surface.

Corresponding to FIG. 1 to 10 a longitudinal element 10 consisting of a base element 11, preferably in the form of a flat base-plate and an attached auxiliary wall member preferably inclined obtusely upwards 12. The horizontal arm of this L-profile rests on sectional support elements 13. The auxiliary wall member 12 can be attached either obtusely, rectangularly or slightly acute and represents the front portion of the plant accommodating wall. When the auxiliary wall member is forwardly inclined, the available planting area increases accordingly. Furthermore, very steep or even vertical walls can be constructed from this relationship of components.

The sectional support elements 13, as shown in FIG. 1 and FIG. 2, may have variable lengths to enable a deeper embedding in the incline to be possible for the lower levels of the plant accommodating wall. Each sectional support element 13 has an upper 14 or a lower 15 seating surface. At the front edge of each sectional support element 13 there is a recess 16 for the installation of the base-plate 11 of the longitudinal element 10. The front edge 17 of the sectional support element 13 can be inclined according to FIG. 1 either rearwardly or, according to FIG. 4 or FIG. 5, forwardly in order to adapt to the obtuse angle between base-plate 11 and auxiliary wall member 12. FIG. 4 shows that a steeper wall can be constructed, when the front edge 17 of the sectional support element is inclined forwards, because in this case the longitudinal elements 10 can be arranged vertically on top of one another and because there is enough room for this arrangement at the upper seating surface 14.

FIGS. 2, 6 and 9 show instances wherein two adjacent longitudinal elements 10 are set with their base-plates on the seating surface 14 of a sectional support element in such a way that the sectional support element covers the so established joint 18. The recesses 16 of the sectional support element 13, according to FIGS. 1 to 4, have no force transmitting functions because the weight of the longitudinal element 10 is transmitted beyond the base-plate on the support underneath. At any rate, the longitudinal elements are shaped and designed in a way that even if the planting-floor is filled with soil, no forces will have an effect on the arm of the auxiliary wall member strong enough to cause a tilting moment.

FIG. 3 shows a horizontal cross section of the supports 13 in girder-type elements 13*a*, 13*b* which have a recess 16 on each level. They can be put on top of one another forming supports of any desired height. It is understood that the girder elements 13*a*, 13*b*, which are of similar shape, can be of different lengths, if necessary, in order to effect a more secure positioning in the lower levels of the slope.

In FIGS. 7 to 9 the seating surfaces 14, 15 of the sectional support elements are arranged to provide extended surfaces 19, 20. Extended surface 20 transmits the horizontal shearing forces of the slope effeccting the support onto the base-plate element 11 of the longitudinal element, whereas the upper extended surface 19 absorbs the horizontal forces which are exerted by the longitudinal elements on top of it and by the slope. Between the front edge 17 of the sectional support elements 13 and the auxiliary wall member 12 there can be a little space in order to avoid pressure on the auxiliary wall member 12 which would require additional reinforcement. This way the auxiliary wall member 12 can be fitted into any optional shape for decorative purposes.

In order to erect steeper walls by means of a support formation corresponding to FIGS. 7 to 9, the height of sectional support element 13 must be increased until the adjoining edge of extended surface 19 and the outside edge of the upper longitudinal profiles lie on top of each other.

More variability of the incline of the wall is achieved by simplifying the supports corresponding to FIGS. 5, 6 where the lower and upper seating-surfaces 14, 15 are divided, which allows the base-element 11 of the longitudinal element sitting on a sectional support element 13 to be moved forward as far as desired. In order to anchor the upper longitudinal elements with the seating-surface 14 of the sectional support element 13, one or more poured-in studs can protrude from the seating-surface. To these studs the connecting links 38 are screwed which cover the base-plate at the side. The connecting links 38 can have any suitable shape provided they can press the longitudinal profile with sufficient force against the sectional support elements 13. As a substitute for the poured-in studs, plugs or screw-sockets 39 can be employed in sufficient quantities as desired for the insertion of studs at the construction site. The sectional support elements 13 corresponding to FIGS. 5 and 6 can have extended surfaces 20 underneath similar to FIGS. 7, 8 to prevent the auxiliary wall member 12 of the longitudinal elements under all circumstances from the influence of shearing forces in order to avoid the necessity of employing additional concrete armouring or reinforcement.

FIG. 10 shows an example of a wall utilized for noise protection. It is constructed from longitudinal elements as shown in FIGS. 1 to 4. For this wall, sectional support elements 22 have been used which show recesses on both sides and are different in length according to each floor, taking into consideration the desired angle of incline. An analogous shape of the sectional support elements 13 corresponding to FIG. 4 makes it possible to construct a vertical protection wall, by aligning each longitudinal element 10 up with the outside edge of the upper seating-surface 14 and by choosing, for the entire height of the wall, sectional support elements of the same length with recesses 16 on both sides.

FIGS. 11 to 14 demonstrate the longitudinal element consisting of a trough-like profile which is especially suitable when the covered slope is to be protected against wetness or root systems, e.g. when there are buildings or basement garages underneath the slope. By means of the trough-like elements, free-standing, plant accommodating walls can be erected in a closed or lattice-like sectional arrangement. A trough-like element 30 consists of a base-plate 31, to which auxiliary wall members 32, 33 are attached on both sides symetrically and obtusely to the wall. Top edge 34, which also can be planned for the auxiliary wall members 12 corresponding to FIGS. 1 to 10, avoid pointed edges and are preferably of simplified form.

The sectional support elements 35 assigned to the trough elements 30 are shorter in height as shown in FIG. 11 than the height of the inner profile of the trough. The auxiliary wall member parts 32, 33 with their extended surfaces 36 can protrude from the base-plate in a length which corresponds in height with the upperside of the sectional support element 35 and with the inner trough profile. This results in a double support of the trough element, which sits with its front lower extended surface 36 on the upper side of the sectional support element 35 and it is supported on its rear side by the edge of the auxiliary wall member 32 underneath.

Trough elements arranged on top of one another vertically can be planted by selecting either higher supports 37 corresponding to FIG. 12, which on their upper side show nearly the same profile as the profile of the trough and the support combined corresponding to FIG. 11, or one chooses a lattice-type arrangement with sparings in certain intervals corresponding to FIG. 14. The trough system consequently is interesting for dividing walls which can be planted and viewed from both sides.

All models of sectional support elements have the function of spacers to make the planting in different floors possible. Another important function of the support is to direct the weight of the soil into the ground of the embankment itself and into the footings of the wall respectively. By means of the sectional support elements it is possible to achieve stability from the L-shaped longitudinal elements simply from their own weight and the relatively small weight of the soil inbetween the planting floors. Consequently, no reinforcement is required. Furthermore, the sectional support elements have the capability of being adjusted to differences in length, comparable to a coupling sleeve between two pipes. In case of an inclined wall, curved 90 degrees, the upper curvature formed of elements which are set back necessarily have a smaller radius. These differences in radius of the various layers lying on top of one another can be adjusted by different joints between the longitudinal elements or by an additional longitudinal element.

The representative inclines and sizes of the construction components and reinforcement walls in the drawings are not binding for the realization of the invention. The auxiliary wall members can be attached to the base-elements at any possible angle. Neither is the width of the base-element of the trough-like element binding in relation to the length of the auxiliary wall member so as to build wider trough elements in the direction of the slope. The possibility of dividing the curbed longitudinal elements into smaller standardized pieces and mitre pieces respectively (FIGS. 15, 16) exists also for all longitudinal elements.

The longitudinal elements and sectional support elements or other components can be constructed of synthetic material, when they are used for walls to reinforce an embankment. The sturdiness of the longitudinal elements need only meet relatively minor requirements because they are embedded in the ground for the most part.

I claim:

1. A system of construction elements for the erection of plant accommodating, slope-retaining walls comprising:

a plurality of L-shaped longitudinal elements arranged in multilevel relationship having a horizontally extending base plate portion and a substantially upwardly extending railing portion providing plant growth medium support surfaces, and a plurality of section support elements acting as vertical partitions along said longitudinal elements, extending horizontally in the direction perpendicular to the direction of said longitudinal elements and protruding into the slope to be retained and having upper and lower seating surfaces adapted to be stacked one upon the other wherein the shearing forces of the earth slope along the wall are sectioned by the vertical partitions, wherein each of said sectional support elements displays a recess in said lower seating surface for overlapping the base plate portion of a longitudinal element supported on said upper seating surface of a lower section support element and wherein the sectioned shearing forces are additionally divided by the base plate portions of the longitudinal elements.

2. The system of claim 1 wherein the base plate portion in the profile of the longitudinal element is short in relation to the length of the railing portion.

3. The system of claim 1 wherein the height of the section support elements is lower than the height of the upwardly extending railing portion of the longitudinal element.

4. The system of claim 1 wherein the railing portion integrally adjoins the base plate portion at obtuse or right angles.

5. The system of claim 1 wherein the vertical distance separating one of the longitudinal elements from the next longitudinal element arranged in a multilevel relationship is defined by at least one section support element in each vertical section.

6. The system of claim 1 wherein the section support elements show upper and lower seating surfaces of flat configuration.

7. The system of claim 1 wherein the longitudinal elements when viewed from above show a curved form and their lateral end faces are provided with miter cuts for arrangement adjacent one another.

8. A system of construction elements for the erection of plant accommodating, slope-retaining walls comprising:

a plurality of L-shaped longitudinal elements arranged in multilevel relationship having a horizontally extending base plate portion and a substantially upwardly extending railing portion providing plant growth medium support surfaces, and a plurality of section support elements acting as vertical partitions along said longitudinal elements, extending horizontally in a direction perpendicular to the direction of said longitudinal elements and protruding into the slope to be retained and having upper and lower seating surfaces adapted to be stacked one upon the other by interposing the base plate portion of said longitudinal elements between said surfaces wherein the shearing forces of the earth slope along the wall are divided by the vertical partitions.

9. The system of claim 8 wherein the front surface of each section support element shows an inclination corresponding to the inclination angle of the upwardly extending railing portion of said longitudinal elements.

10. The system of claim 8 wherein the railing portion integrally adjoins the base plate portion at obtuse or right angles.

11. The system of claim 8 wherein the section support elements show upper and lower seating surfaces of flat configuration.

12. The system of claim 8 wherein at least one stud protrudes the upperside of each sectional support element for the fastening of a butt strap which covers the ends of the base plates of two adjacent longitudinal elements.

13. The system of claim 8 wherein plugs or screw sockets are molded on the upper surface of each sectional support element for bolts that can be screwed into said sockets.

14. A system of construction elements for erection of plant accommodating, slope-retaining walls comprising:

a plurality of L-shaped longitudinal elements arranged in multilevel relationship having a horizontally extending base portion and a substantially upwardly extending railing portion providing plant growth medium support surfaces and, a plurality of section support elements acting as vertical partitions along said longitudinal elements, extending horizontally in a direction perpendicular to the direction of said longitudinal elements and protruding into the slope to be retained and having on the upper and lower seating surfaces symmetrical mirror-imaged setoffs wherein said setoffs absorb horizontal shearing forces and wherein the rear edge of said base plate portion of a lower longitudinal element adjoins said lower setoff and the front edge of said base plate portions of the longitudinal elements of the next upper level adjoins said upper setoff.

* * * * *